US006439802B1

(12) United States Patent
Duckett

(10) Patent No.: US 6,439,802 B1
(45) Date of Patent: Aug. 27, 2002

(54) INTERCONNECTED TELESCOPING MOVABLE ROADWAY BARRIER MODULES

(75) Inventor: John W. Duckett, Carson City, NV (US)

(73) Assignee: Barrier Systems, Inc., Rio Vista, CA (US)

( * ) Notice: Subject to any disclaimer, the term of this patent is extended or adjusted under 35 U.S.C. 154(b) by 0 days.

(21) Appl. No.: 09/687,693

(22) Filed: Oct. 13, 2000

Related U.S. Application Data

(63) Continuation-in-part of application No. 09/227,732, filed on Jan. 8, 1999, now abandoned.
(60) Provisional application No. 60/070,860, filed on Jan. 9, 1998.

(51) Int. Cl.[7] ..... E01F 13/00
(52) U.S. Cl. ..... 404/6
(58) Field of Search ..... 404/6; 256/13.1; 49/34, 49, 98, 9

(56) References Cited

U.S. PATENT DOCUMENTS

| | | | | | |
|---|---|---|---|---|---|
| 4,500,225 | A | * | 2/1985 | Quittner | 404/6 |
| 4,502,812 | A | * | 3/1985 | Zucker | 404/6 |
| 4,632,598 | A | * | 12/1986 | Richards | 404/6 |
| 4,815,889 | A | * | 3/1989 | Duckett | 404/6 |
| 5,211,503 | A | * | 5/1993 | Quittner | 404/6 |
| 5,217,318 | A | * | 6/1993 | Peppel | 404/6 |
| 5,498,100 | A | * | 3/1996 | Guernsey | 404/6 |
| 6,200,063 | B1 | * | 3/2001 | Fritzinger | 404/6 |
| 6,213,047 | B1 | * | 4/2001 | Means et al. | 116/28 R |

* cited by examiner

*Primary Examiner*—Gary S. Hartmann
(74) *Attorney, Agent, or Firm*—Thomas R. Lampe

(57) ABSTRACT

A roadway barrier includes a plurality of movable roadway barrier modules forming a barrier chain, hardware for connecting the barrier modules together to form a first length, and a control for resisting increase and decrease of the barrier chain length when the barrier chain is in place on a roadway, and for permitting increase and decrease of the barrier chain length when the barrier chain is raised from the roadway by a transfer machine.

13 Claims, 3 Drawing Sheets

INTERCONNECTED TELESCOPING MOVABLE ROADWAY BARRIER MODULES

This application is a CIP of U.S. patent application Ser. No. 09/227,732, filed Jan. 8, 1999, now abandoned which claims benefit of 60/070,860 filed Jan. 9, 1998.

TECHNICAL FIELD

This invention relates generally to roadway barriers, and more specifically to an improved method and apparatus for interconnecting roadway barrier segments to minimize lateral displacement upon impact.

BACKGROUND ART

One type of moveable roadway barrier system is adapted to be lifted by a mobile transfer vehicle and moved to a selected position on a roadway. Moveable barrier systems of this type find particular application at roadway construction sites and on roadways and bridges where the groupings of incoming and outgoing lanes of traffic must be varied, such as is common during commute hours.

The barrier system itself comprises a series of interconnected concrete and steel modules hinged together to form a continuous chain. The cross-section of each module is similar to that of other types of roadway barriers, and may have a T-shaped top section. A standard module has a height of approximately thirty-two inches, a length of approximately thirty-nine inches and a weight of approximately 1400 pounds. The modules are pivotally connected together by inserting a steel pin through hinge components attached to the ends of each adjacent pair of modules.

The self-propelled transfer vehicle includes a conveyor system for shifting the barrier system laterally across the roadway from a first side to a second side of the vehicle. The shift or lateral displacement of the barrier system can be normally varied from four to over twenty-six feet. The conveyor system includes a plurality of guide and support wheels or rollers that function to engage beneath the T-shaped top section of the modules for lifting and transfer purposes.

The modules move through a serpentine-like transfer path (i.e., an elongated "S" curve) for accurate positioning thereof to define a repositioned lane line. The modules are moved at a speed approximating five miles per hour through the conveyor system. Oftentimes, the transfer vehicle must negotiate curved sections of roadways whereby the barrier system is likewise curved.

U.S. Pat. Nos. 4,806,044 and 4,828,425, both assigned to the assignee of this application, each address the long-standing problem of providing a barrier system that will elongate or contract to accommodate positioning of the system at varied radii on a curved roadway. The original barrier system, disclosed in U.S. Pat. No. 4,500,225, is particularly useful for straight-line roadway applications and utilizes a hinge connection between each adjacent pair of modules. The hinge connection includes aligned circular holes, formed in overlying hinge plates, adapted to receive a hinge pin therethrough. However, even when the holes are lined with a thin (e.g., ⅛" wall thickness) elastomeric bushing, the modules may not elongate as a unit when the system is moved radially on a curved roadway.

For example, it has been determined that when the barrier system is moved from a 2,000 foot radius to a 2,012 foot radius, the composite length of the barrier system must increase by approximately 0.214 inches for each barrier segment (of 3.28 feet, pin to pin) of the barrier system to effectively accommodate this new position on the same, curved roadway. Conversely, repositioning of the barrier system radially inwardly to a new position on the curved roadway, having a radius of curvature of 1,988 feet, will require a corresponding contraction of the composite length of the lane barrier system. In the above example, it should be understood that the ends of the barrier system are preferably located at the same relative radial position on the curved roadway thus require the aforementioned composite elongation or retraction of the system.

One solution to the latter problem of compensating for curvatures of varied radii on a curved roadway has been to substitute elongated slots for the pin-receiving circular holes, formed in the hinge plates. The slots allow the lane barrier system to assume various radii, as described in the above example. However, it has proven further desirable to return the spacing between each adjacent pair of modules to a nominal one when the barrier system is loaded onto a transfer vehicle and thereafter returned to its normal position on a roadway, e.g., the above-mentioned radius of 2000 ft.

Repeated transfer of the modules, having slotted hinge plates, will tend to "stack-up" the modules towards one of the ends of the lane barrier system which may interfere with effective transfer and placement of the modules in their correct positions. In particular, it is desirable to maintain the pivot pin between each adjacent pair of modules at a centered position therebetween (and reestablish the nominal spacing) when the barrier system is returned to its nominal position on a roadway. This feature, when achieved, facilitates the efficient transfer of the system by the type of transfer and transport vehicle described in the above-referenced patents.

The invention described by above-referenced U.S. Pat. No. 4,806,044 addresses this problem by providing elastomeric pads in the hinge connections, between each pair of adjacent modules of the barrier system, whereby the modules will: (1) elongate or contract to assume a composite varied length different from their nominal composite length in response to the imposition of a load on the system, and (2) return the modules to their nominal composite length when the load is removed (i.e., self-centering hinges). The invention described by U.S. Pat. No. 4,828,425 addresses the problem by preloading the hinges, connecting adjacent pairs of modules together, to facilitate a high degree of uniform spacing between the modules when they are moved through the conveyor of a self-propelled transfer vehicle for subsequent replacement on a roadway.

Duckett U.S. Pat. No. 4,815,889 teaches a lane barrier system with a pivot control connected to at least one of the hinge connections between barrier modules, and permitting the pivot axis to move between the modules whereby the overall length of the connected modules, is capable of elongating or contracting. Thus, the elongation and contraction is accomplished by the hinge connections, and not the barrier itself.

When impacted by a vehicle, the lateral displacement of a chain of barrier modules immediately starts to occur which induces tension into the entire chain as the hinges become "two-blocked" (i.e., solidly locked together). As the lateral movement increases, the tension in the chain increases and a force resisting the lateral movement is developed. However, and as described supra, a chain of barriers must have the ability to increase or decrease the circumferential length to allow the chain to be moved outwardly or inwardly from a given radius of curvature on a roadway. Because of this requirement, each barrier hinge should have the ability to expand or contract a nominal distance (e.g., one-half inch). Therefore, upon impact, the barrier will move laterally until each hinge is "two-blocked" and the tension in the barrier chain is adequate to overcome the lateral force.

The above-referenced methods of hinge connection result in a barrier chain that is subject to greater lateral displacement upon impact by a vehicle than the current invention. Such lateral displacement can be problematic, especially in situations of high impact severity.

DISCLOSURE OF INVENTION

The purpose of this invention is to eliminate the allowance of additional space in each hinge between each barrier while at the same incorporating some other mechanism which will allow the chain of barriers to become longer or shorter when it is necessary for the radius of the chain to be increased or decreased. This invention utilizes individual hinge mechanisms between each barrier module such that when the barrier chain is deployed on a roadway, the barrier modules will be maintained at all times in a metal to metal contact (two-blocked), that is, in a condition which will cause the barrier chain to go immediately into tension upon any lateral movement (such as by a vehicle impact).

The preferred system utilizes two principal elements:

1. A capstan drive system on the transfer machine which will maintain a slight degree of tension as the barrier chain is deployed; and
2. At least one variable length barrier module in the barrier chain which includes a hydraulic or mechanical mechanism which allows it to expand or contract in length (and which may be spring biased to a preferred position) to allow for the required geometric changes during the transfer process, but which will be locked into position in the deployed position so that it cannot expand when the chain of barrier is put into tension from a vehicle impact. It is this second element which is the subject of this application.

The inventive method and apparatus minimizes the lateral displacement of a series of interconnected barriers (e.g., concrete with steel reinforcement, or steel with concrete filling) when impacted by a vehicle with an extremely high impact severity, such as is required by the NCHRP testing procedures to assure that the vehicle will not penetrate the barrier. Although this invention relates primarily to a "permanent" moveable barrier system, the principle is also applicable to a "temporary" type of moveable barrier system.

BEST MODE FOR CARRYING OUT THE INVENTION

Figure 1:
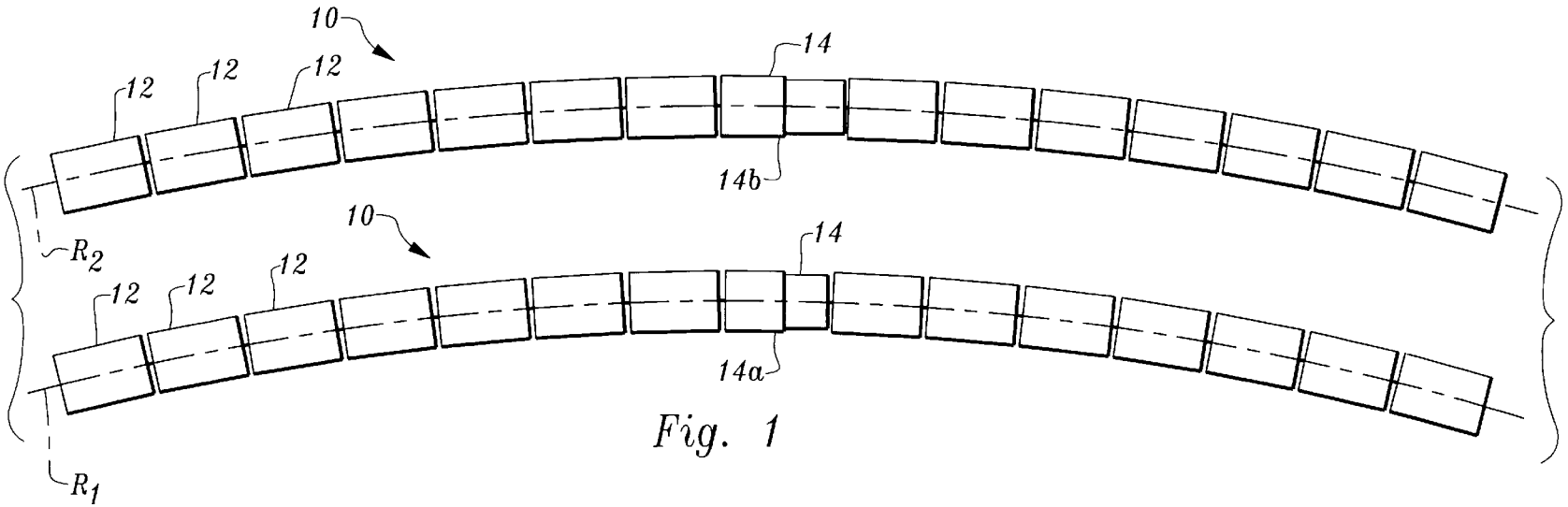
FIG. 1 is a top plan view of a chain of roadway barriers deployed on a first (smaller) radius and a second (larger) radius.

FIG. 1 is a top plan view of a chain 10 of roadway barriers 12 deployed on a first (smaller) radius R1 and a second (larger) radius R2, depicting a transfer on a curve situation. As described supra, chain 10 must extend in length in order to accommodate the new position on the larger radius. This extended length is accomplished by inclusion of variable length barrier module 14 (described infra), illustrated in its initial length configuration 14*a* on smaller radius R1, and in its extended length configuration 14*b* on larger radius R2.

Figure 2:
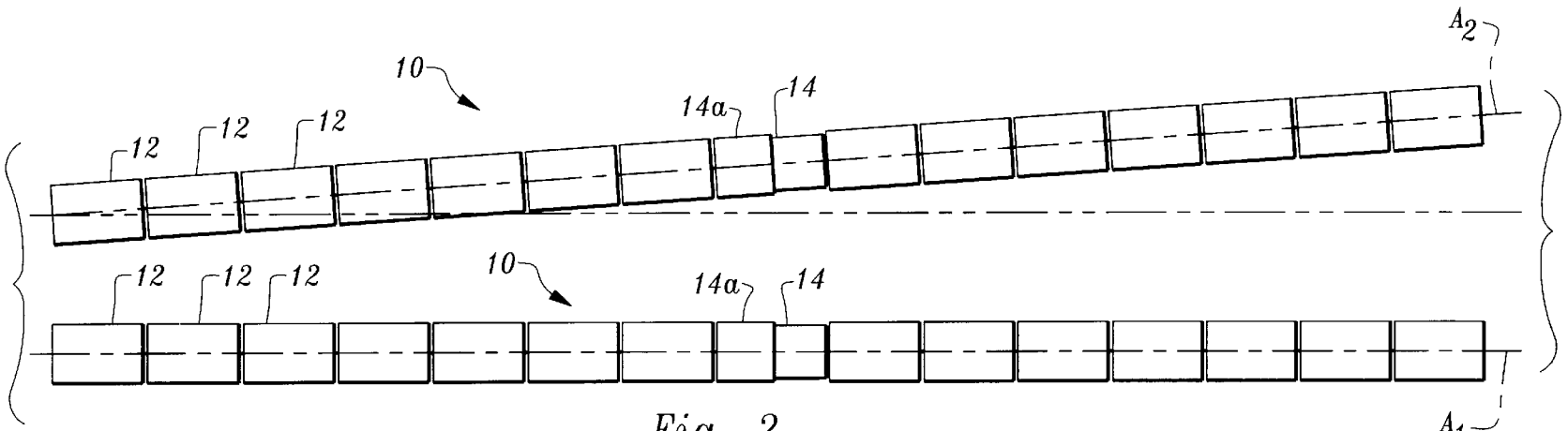
FIG. 2 is a top plan view of a chain of barriers deployed on a first (parallel to traffic) alignment and second (non-parallel to traffic) alignment.

FIG. 2 is a top plan view of a chain 10 of barriers 12 deployed on a first (parallel to traffic) alignment A1 and second (non-parallel to traffic) alignment A2. This transfer on a taper situation is similar to that of the transfer on a curved roadway situation depicted in FIG. 1 in that the extended length necessary to accommodate the new position is accomplished by variable length barrier module 14, illustrated in its initial length configuration 14*a* on first alignment A1, and in its extended length configuration 14*b* on second alignment A2.

Figure 3A:
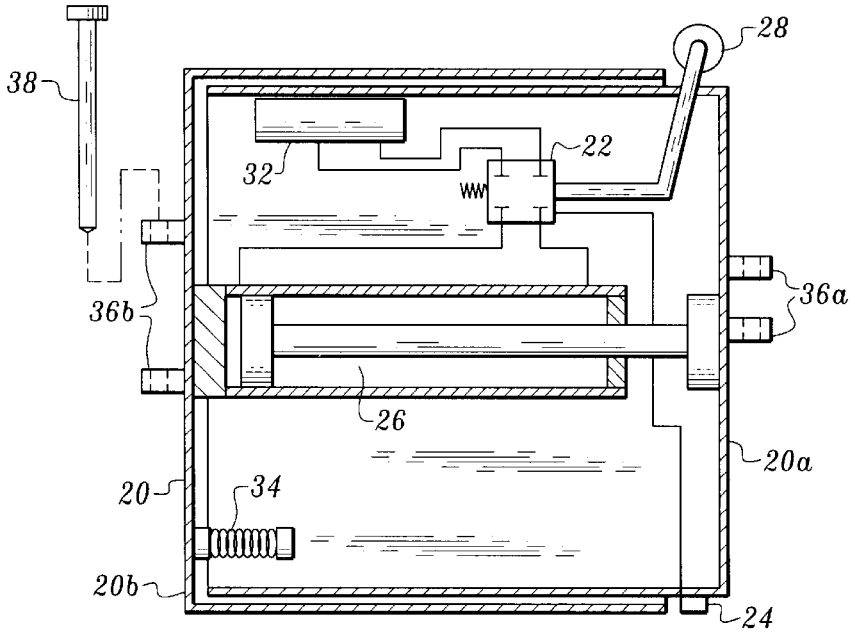
FIG. 3*a* is a schematic view of a hydraulic cylinder embodiment of a variable length barrier of this invention in its deployed state.
Figure 3B:
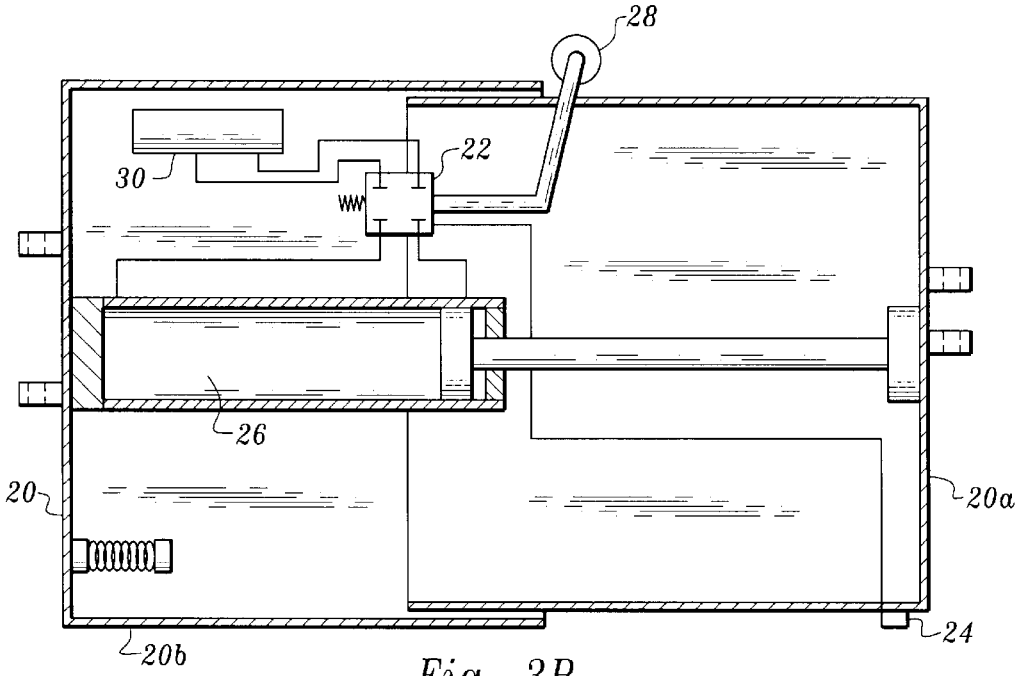
FIG. 3*b* is a view of the hydraulic cylinder embodiment of FIG. 3*a* in its movable (adjustable-length) state.

FIG. 3*a* is a schematic view of a hydraulic cylinder embodiment 20 of a variable length barrier of this invention in its deployed state while FIG. 3*b* is a view of the hydraulic cylinder embodiment 20 of FIG. 3*a* in its movable (adjustable-length) state. This hydraulic variable length barrier 20 includes inner and outer variable length barrier structures 20*a*, 20*b*, respectively, and utilizes a valve system 22 which is actuated by contact with the ground (for example, by actuating valve or contact switch 24, or alternative actuation) such that the valve 22, when the barrier is in a stationary, deployed position on the ground is closed, and no hydraulic movement through hydraulic cylinder 26 (connecting inner and outer structures 20*a*, 20*b*) can occur. When the barrier is lifted by a transfer vehicle, the valve 22 is opened, allowing the cylinder to expand and contract as required by the particular geometric configuration for the transfer. Alternatively, the valve 22 may be actuated by the transfer machine itself, such as with a plunger 28 which could be depressed by an inclined plane or otherwise actuated as the transfer machine moves over the variable length barrier. These variable length barriers 20 may be placed in the barrier chain so that at all, times at least one is off the ground in the transfer machine and free to expand or contract. Alternatively, there may be more than one or less than one variable length barrier in the transfer machine at any given time. This flexibility may be necessary to accommodate movements around curves, up or down vertical grades, and in large and small transfer situations.

Figure 3C:
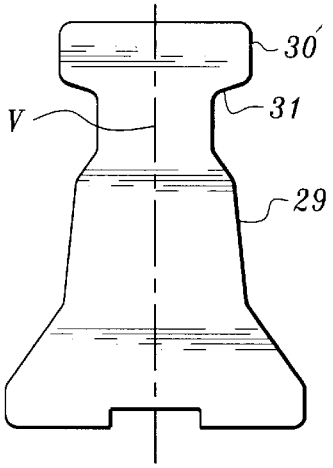
FIG. 3*c* is an end view of a variable length barrier of this invention.

The inner and outer variable length barrier structures 20*a*, 20*b* each include sidewalls 29 which may be vertical, or, as illustrated in FIG. 3*c*, taper upwardly and inwardly to intersect a T-shaped upper portion 30 having undercut surfaces 31 extending laterally outwardly from a central vertical axis V of the module and past critical impact points on the module. The sidewalls and undercut surfaces are configured to aid in the precise deflection, guidance, and capturing of the bumper of a passenger vehicle or light duty truck when the bumper impacts the module to prevent the vehicle from catapulting over the system. In addition, the rollers of the transfer vehicle conveyor system function to engage beneath the T-shaped top section of the modules for lifting and transfer purposes. The inner and outer variable length barrier structures 20*a*, 20*b* are connected together in telescoping arrangement with hydraulic cylinder 26 which can extend or retract. With the valve 22 in the first position, the inner and outer VLB structures are prevented from relative movement by hydraulic oil being trapped in the hydraulic cylinder 26. When the valve 22 is urged into the second or open position, the hydraulic cylinder 26 can now quickly pass hydraulic fluid through the valve 22 and on to the fluid reservoir 32, so that the inner and outer VLB structures 20*a*, 20*b* may freely extend and retract. This is needed to accommodate the distance change when deploying the barrier chain on a radius or taper. As discussed, valve actuation can be accomplished by the barrier transfer machine such as by depressing a valve actuator with a device on the machine, or by ground contact of the barrier, or other means. The variable length barrier modules may also include a spring 34 or other device to normally urge the modules together. This may help to ensure that the system is always under tension in order to keep the system two-blocked.

Inner and outer VLB structures are preferably interconnected by hardware or brackets such as hinges 36*a*, 36*b* on respective ends of the module 20, secured together by one or more connecting pins 38, as is well known in the art. In the preferred embodiment, these hinges are maintained in metal to metal contact when the barrier chain is deployed.

Figure 4B:
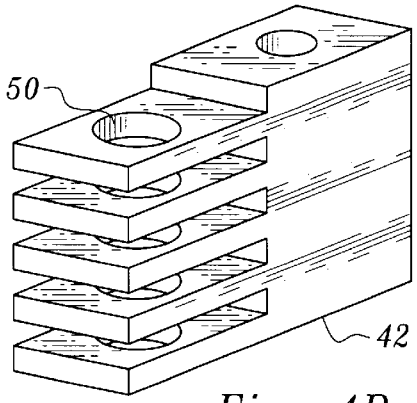
FIG. 4*b* is a perspective view of a finger block portion of the mechanical embodiment of FIG. 4*a*.
Figure 4A:
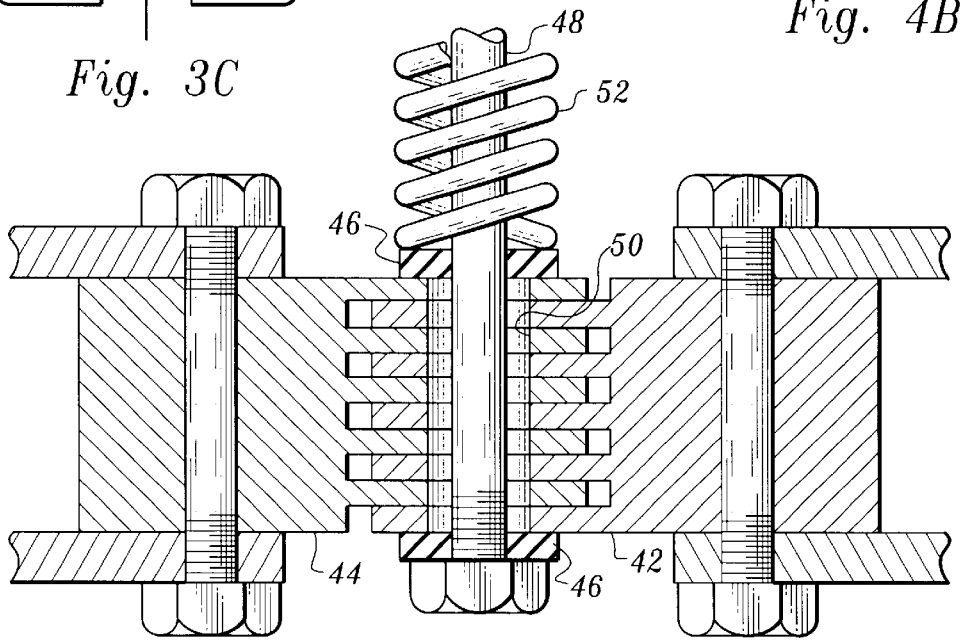
FIG. 4*a* is a side elevation cross-sectional view of a mechanical embodiment of a variable length barrier of this invention.

FIG. 4*a* is a side elevation cross-sectional view of a mechanical embodiment 40 of a variable length barrier of this invention, while FIG. 4*b* is a perspective view of a finger block portion 42 of the mechanical embodiment of FIG. 4*a*. Here, the mechanical means for length variability may consist of a series of interleaved mechanical fingers from opposed finger blocks 42, 44 which under compression from pads 46 on shaft or pin 48 develop adequate frictional forces when a perpendicular load is applied to them to resist the necessary longitudinal tension force, but which under reduced compression allow movement (i.e., extension or retraction of length) by movement of pin 48 within oversize hole 50. This net compressive force could be provided by, e.g., spring or other compression means 52, and varied (reduced) as it passes through the transfer machine. Each finger block can be attached to a specific barrier module for connection with the complementary finger block on the adjacent barrier module, or the respective finger blocks can be connected to the inner and outer VLB structures of a single module.

Figure 5:
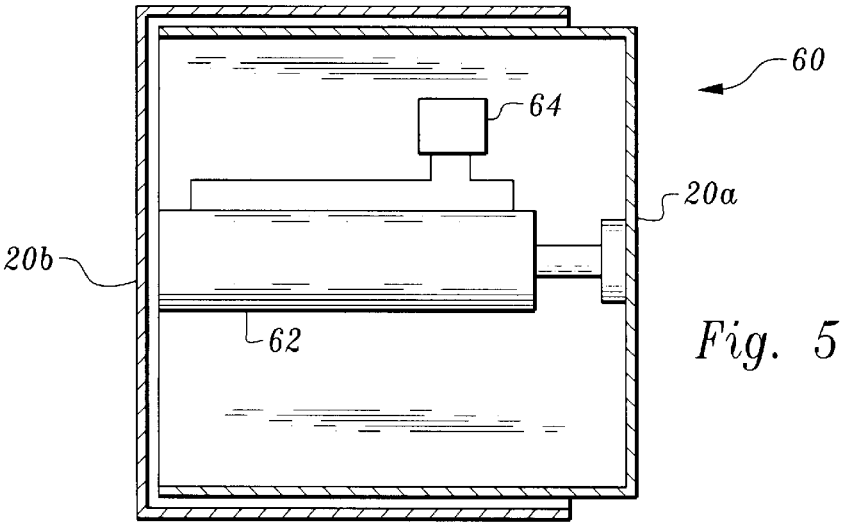
FIG. 5 is a schematic view of a velocity fuse embodiment of a variable length barrier of this invention.

FIG. 5 is a schematic view of a velocity fuse embodiment 60 of the variable length barrier of this invention. This embodiment again includes inner and outer VLB structures 20*a*, 20*b*, this time connected together with linkage 62 including hydraulic or velocity fuse 64. A velocity fuse (also known as an automatic stop valve, safety valve, excess flow check valve, and hydraulic or fluid circuit breaker valve) is a fixed flow (preset) valve which provides a predetermined maximum flow rate, such that if the flow exceeds the preset rate the fuse will snap closed and remain closed until the pressure to the fuse is reduced. The free flow pressure drop is determined by orifice size. Design criteria for a given application will normally dictate the particular velocity fuse specifications.

The velocity fuse restricts relatively rapid flow of fluid through its orifice, thereby resisting extension and retraction of the inner and outer VLB modules when the modules are subject to a relatively high tension force such as induced in a vehicle impact upon the barrier chain, but permits relatively slow flow of fluid through its orifice, thereby enabling extension and retraction of the inner and outer VLB modules when the modules are subject to a relatively low tension force such as induced during conveyance by a transfer machine.

While the relative levels of force on the system during impact and during transfer may vary upon the particular circumstances and deign criteria, it has been determined that the maximum velocity imposed upon the system during an impact is approximately ten to fifteen times that of the maximum velocity during normal transfer conditions. However, use of a velocity fuse as the VLB control mechanism does impose some conditions on the rate of transfer on a curve. For example, it may be preferable to limit seven mile per hour transfers of twenty-four feet to a 1500 foot radius. The transfer speed or radius could be made more severe if required by adding additional VLB's in the barrier chain.

Any of the above-described embodiments maybe used and incorporated into individual "variable length barrier" modules which are periodically placed in the barrier chain (e.g., perhaps every tenth to fifteenth barrier, or otherwise as the particular application requires). In the preferred embodiment, a discrete number of variable length barrier modules help keep the entire barrier chain in tension.

Thus, the invention can be characterized as a variable length roadway barrier module having a inner and outer barrier module structures each having sidewalls that extend upwardly to intersect a T-shaped upper portion having undercut surfaces extending laterally outwardly from a central vertical axis of the module, the outer barrier module adapted for telescoping engagement with the inner barrier module; hardware connecting the inner and outer barrier module structures; and a control for selectively enabling extension and retraction of the inner barrier module structure relative to the outer barrier module structure, such that when the control is in a first state, it resists the extension and retraction of the inner and outer barrier module structures relative to one another, and when the control is in a second state, it permits the extension and retraction of the inner and outer barrier module structures relative to one another.

The invention can further be characterized as a roadway barrier apparatus including a plurality of movable roadway barrier modules forming a barrier chain, having hardware for connecting the barrier modules together to form a first length, and a control for resisting increase and decrease of the barrier chain length when the barrier chain is in place on a roadway, and for permitting increase and decrease of the barrier chain length when the barrier chain is raised from the roadway by a transfer machine.

The invention can further be characterized as a method for interconnecting a plurality of movable roadway barrier modules to form a barrier chain with hinge mechanisms between each barrier module conditioned to cause the barrier chain to go into tension upon any lateral movement, providing at least one variable length barrier module in the barrier chain having a inner and outer barrier module structures in telescoping arrangement, and a control for selectively enabling extension and retraction of the inner barrier module structure relative to the outer barrier module structure; and providing a transfer vehicle adapted to move the barrier chain from a first location to a second location, such that when the variable length barrier module is moved by the transfer vehicle the inner and outer barrier module structures are adapted for extension and retraction relative to one another, and when the variable length barrier module is placed on a roadway and subject to impact by a vehicle, the control resists the extension and retraction of the inner and outer barrier module structures relative to one another.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims and their legal equivalents.

What is claimed as invention is:

1. A variable length roadway barrier module for pivotal connection to one or more other modules to form a movable roadway barrier chain and for selectively lengthening or shortening said movable roadway barrier chain responsive to lateral displacement of said movable roadway barrier chain, said variable length roadway barrier module comprising:

a first barrier module structure;

a second barrier module structure, said first and second barrier module structures being selectively movable relative to one another and including connection means for connecting said variable length roadway barrier module to at least one other module of a movable roadway barrier chain;

connector means connecting said first barrier module structure to said second barrier module structure; and control means operatively associated with said connector and with said first barrier module structure and said second barrier module structure for selectively enabling extension and retraction of said first barrier module structure relative to said second barrier module structure responsive to movement of said variable length roadway barrier module, said control means when in a first state resisting the extension and retraction of said first and second barrier module structures relative to one another, and said control means when in a second state preventing the extension and retraction of said first and second barrier module structures relative to one another.

2. The variable length roadway barrier module of claim 1 wherein said connector means connecting said first and second barrier module structures comprises a hydraulic cylinder.

3. The variable length roadway barrier module of claim 2 wherein said control means comprises a valve having a first state preventing passage of fluid through said hydraulic cylinder, and a second state permitting passage of hydraulic fluid through said hydraulic cylinder.

4. The variable length roadway barrier module of claim 3 wherein said valve is actuated into said first state by contact with the ground.

5. The variable length roadway barrier module of claim 3 wherein said valve is actuated into said first state by contact with a transfer machine.

6. The variable length roadway barrier module of claim 1 wherein said connector means connecting said first and second barrier module structures comprises a series of interleaved mechanical fingers projecting from said first and second barrier module structures.

7. The variable length roadway barrier module of claim 1 wherein said control means comprises a velocity fuse adapted to resist extension and retraction of said first and second barrier modules when subject to a first force, and to permit extension and retraction of said first and second barrier modules when subject to a lesser force.

8. The variable length roadway barrier module of claim 7 wherein said first force comprises the force induced in a vehicle impact upon one or more modules in a movable roadway barrier chain.

9. The variable length roadway barrier module of claim 7 wherein said lesser force comprises the force induced in conveyance of the variable length roadway barrier by a transfer machine.

10. The variable length roadway barrier module of claim 1 including a spring to bias said first and second barrier module structures together.

11. A variable length roadway barrier module comprising:

an inner barrier module structure having sidewalls that extend upwardly to intersect a T-shaped upper portion having undercut surfaces extending laterally outwardly from a central vertical axis of the module;

an outer barrier module structure having sidewalls that extend upwardly to intersect a T-shaped upper portion having undercut surfaces extending laterally outwardly from a central vertical axis of the module, said outer barrier module adapted for telescoping engagement with said inner barrier module;

means for connecting said inner and outer barrier module structures; and control means for selectively enabling extension and retraction of said inner barrier module structure relative to said outer barrier module structure, wherein when said control means is in a first state, said control means resists the extension and retraction of said inner and outer barrier module structures relative to one another, and when said control means is in a second state, said control means permits the extension and retraction of said inner and outer barrier module structures relative to one another, said means for connecting said inner and outer barrier module structures comprising a hydraulic cylinder and said control means comprising a valve having a first state preventing passage of fluid through said hydraulic cylinder, and a second state permitting passage of hydraulic fluid through said hydraulic cylinder.

12. The variable length roadway barrier module of claim 11 wherein said valve is actuated into said first state by contact with the ground.

13. The variable length roadway barrier module of claim 11 wherein said valve is actuated into either said first state or said second state by contact with a transfer machine.

* * * * *